United States Patent [19]

Dickakian

[11] Patent Number: 4,518,482

[45] **Date of Patent: * May 21, 1985**

[54] PITCH FOR DIRECT SPINNING INTO CARBON FIBERS DERIVED FROM A COAL DISTILLATE FEEDSTOCK

[75] Inventor: Ghazi Dickakian, Greenville, S.C.

[73] Assignee: E. I. Du Pont de Nemours and Company, Wilmington, Del.

[ * ] Notice: The portion of the term of this patent subsequent to May 15, 2001 has been disclaimed.

[21] Appl. No.: 399,702

[22] Filed: Jul. 19, 1982

[51] Int. Cl.[3] ..... C10C 3/00; D01F 9/14

[52] U.S. Cl. ..... 208/22; 208/39; 208/44; 423/447.1; 423/447.2; 423/447.4; 423/447.6

[58] Field of Search ..... 264/176 F; 208/22, 40, 208/44; 423/447.1, 447.2, 447.4, 447.6

[56] References Cited

U.S. PATENT DOCUMENTS

| | | | |
|---|---|---|---|
| 2,066,386 | 1/1937 | Bergeim | 208/41 |
| 3,928,169 | 12/1975 | Conroy | 208/22 |
| 4,184,942 | 1/1980 | Angier et al. | 208/44 |
| 4,208,267 | 6/1980 | Diefendorf et al. | 208/22 |
| 4,219,409 | 8/1980 | Dickakian | 208/22 |
| 4,271,006 | 6/1981 | Dikakian | 208/45 |
| 4,363,415 | 12/1982 | Dickakian | 208/44 |

*Primary Examiner*—Delbert E. Gantz
*Assistant Examiner*—Helane Myers

[57] ABSTRACT

A pitch suitable for carbon fiber manufacture features a pitch having a weight content of between 80 and 100 percent toluene insolubles. The pitch is derived from a deasphaltenated fraction of a feedstock. The pitch is characterized as being relatively free of impurities and ash. The pitch can be spun directly into carbon fibers.

5 Claims, 2 Drawing Figures

PITCH FOR DIRECT SPINNING INTO CARBON FIBERS DERIVED FROM A COAL DISTILLATE FEEDSTOCK

FIELD OF THE INVENTION

This invention pertains to an aromatic pitch containing a high liquid crystal (optically active) fraction, and more particularly to a pitch which can be directly spun into carbon fibers.

BACKGROUND OF THE INVENTION

As is well-known, the catalytic conversion of virgin gas oils containing aromatic, naphthenic and paraffinic molecules results in the formation of a variety of distillates that have ever-increasing utility and importance in the petrochemical industry. The economic and utilitarian value, however, of the residual fractions of the cat cracking processes (also known as cat cracker bottoms) has not increased to the same extent as have the light overhead fractions. One potential use for such cat cracker bottoms is in the manufacture of carbon artifacts. As is well-known, carbon artifacts have been made by pyrolyzing a wide variety of organic materials. Indeed, one carbon artifact of particularly important commercial interest is carbon fiber. Hence, particular reference is made herein to carbon fiber technology. Nevertheless, it should be appreciated that this invention has applicability to carbon artifacts in a general sense, with emphasis upon the production on shaped carbon articles in the form of filaments, yarns, films, ribbons, sheets, etc.

The use of carbon fibers for reinforcing plastic and metal matrices has gained considerable commercial acceptance. The exceptional properties of these reinforcing composite materials, such as their high strength to weight ratio, clearly offset their high preparation costs. It is generally accepted that large scale use of carbon fibers as reinforcing material would gain even greater acceptance in the marketplace, if the costs of the fibers could be substantially reduced. Thus, the formation of carbon fibers from relatively inexpensive carbonaceous pitches has received considerable attention in recent years.

Many materials containing polycondensed aromatics can be converted at early stages of carbonization to a structurally ordered optically anisotropic spherical liquid crystal called mesophase. The presence of this ordered structure prior to carbonization is considered to be fundamental in obtaining a high quality carbon fiber. Thus, one of the first requirements of a feedstock material suitable for carbon fiber production, is its ability to be converted to a highly optically anisotropic material.

In addition, suitable feedstocks for carbon artifact manufacture, and in particular carbon fiber manufacture, should have relatively low softening points and sufficient viscosity suitable for shaping and spinning into desirable articles and fibers.

Unfortunately, many carbonaceous pitches have relatively high softening points. Indeed, incipient coking frequently occurs in such materials at temperatures where they have sufficient viscosity for spinning. The presence of coke, infusible materials, and/or high softening point components, are detrimental to the fiber-making process. Thus, for example, U.S. Pat. No. 3,919,376 discloses the difficulty in deforming pitches which undergo coking and/or polymerization at the softening temperature of the pitch.

Another important characteristic of the feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40%, at that minimum temperature. Mesophase, of course, can be generated in shorter times by heating at higher temperatures. However, as indicated above, incipient coking and other undesirable side reactions take place at temperatures in excess of about 425° C.

In U.S. Pat. No. 4,208,267, it has been disclosed that typical graphitized carbonaceous pitches contain a separable fraction which has important physical and chemical properties. Indeed, this separable fraction exhibits a softening range and viscosity suitable for spinning. It also has the ability to be converted rapidly (at temperatures in the range generally of about 230° C. to about 400° C.) to an optically anisotropic, deformable, liquid crystalline material structure. Unfortunately, the amount of separable fraction present in well-known commercially available petroleum pitches, such as Ashland 240 and Ashland 260, to mention a few, is exceedingly low. For example, with Ashland 240, no more than about 10% of the pitch constitutes a separable fraction capable of being thermally converted to a deformable anisotropic phase.

In U.S. Pat. No. 4,184,942, it has been disclosed that the amount of the aforementioned fraction yielding an optical anisotropic pitch can be increased by heat soaking the feedstock at temperatures in the range of 350° C. to 450° C., until spherules visible under polarized light begin to appear.

In U.S. Pat. No. 4,219,404, it has been disclosed that the polycondensed aromatic oils present in isotropic graphitizable pitches are generally detrimental to the rate of formation of highly anisotropic material in such feedstocks when they are heated at elevated temperatures and that, in preparing a feedstock for carbon artifact manufacture, it is particularly advantageous to remove at least a portion of the polycondensed aromatic oils normally present in the pitch simultaneously with, or prior to, heat soaking of the pitch for converting it into a feedstock suitable in carbon artifact manufacture.

More recently, in U.S. Pat. No. 4,271,006 (June 2, 1981), a process has been disclosed for converting cat cracker bottoms to a feedstock suitable in carbon artifact manufacture. Basically, the process requires stripping cat cracker bottoms of fractions boiling below 400° C. and thereafter heat soaking the residue followed by vacuum stripping to provide a carbonaceous pitch.

Cat cracker bottoms like all other heavy aromatic residues obtained from steam cracking, fluid cracking or coal processing are composed of two components: (1) a low molecular weight oil fraction which can be distilled; and (2) an undistillable fraction of high molecular weight. This high molecular weight fraction is insoluble in paraffinic solvents such as n-heptane, isooctane, pet ether, etc. This fraction is generally called "asphaltene".

It is preferred to use an asphaltene-free feed for the production of pitches. These asphaltenes have a very high molecular weight (up to 10,000), a very high coking characteristic (coking value as high as 67.5 wt% coke yield at 550° C.), and a very high melting point (200°-250° C.).

It is desired to use an asphaltene-free cat cracker bottom. The asphaltene-free cat cracker bottom is free of ash, coke particles and other impurities. The absence of asphaltene, ash, coke particles and other organic and inorganic impurities make the cat cracker bottom distillate an ideal feed for the production of an aromatic pitch with a very high content of liquid crystals. This asphaltene-free cat cracker bottom can be prepared by two methods: (a) by a distillation process; e.g., vacuum or steam distillation; and (b) by deasphaltenation of the cat cracker bottom. The deasphaltenation can be made readily by solvent extraction with a paraffinic solvent.

In application U.S. Ser. No. 291,990 (filed Aug. 11, 1981) and assigned to a common assignee a process is described for heat soaking a deasphaltenated cat cracker bottom.

In application U.S. Ser. No. 225,060 (filed Jan. 14, 1981) and assigned to a common assignee a process is described for obtaining a feedstock with a low liquid crystal fraction by heat soaking a distillate derived from a cat cracker bottom. The pitch produced in the above application, Ser. No. 225,060 cannot be used directly for carbon fiber production. The liquid crystal fraction has to be extracted from the pitch and used for fiber production.

Whereas, application U.S. Ser. No. 225,060 teaches that all of the cat cracker bottoms can be used to obtain a pitch having low toluene insolubles (Ti), the present invention teaches the opposite, i.e. obtaining a pitch from fractions of the cat cracker bottoms which has a high Ti content (a high content of liquid crystals).

The present invention uses deasphaltenated feedstock fractions to provide a pitch having a high Ti content, and one which does not require Ti solvent extraction prior to spinning into fibers.

The deasphaltenated fractions of a feedstock in accordance with this invention is generally free of ash and impurities, and has the proper rheological properties to allow direct spinning into carbon fibers. The pitch obtained from this fraction produces fibers which have high strength and performance. For example, a deasphaltenated cat cracker bottom fraction obtained in accordance with the present invention, has virtually no coking value at 550° C. compared with a 56% standard coking value for Ashland 240. The deasphaltenated cat cracker bottom fraction is composed of 4, 5, and 6 polycondensed aromatic rings. This provides a uniform feed material which can be carefully controlled to produce a uniform product with a narrow molecular weight distribution.

SUMMARY OF THE INVENTION

The present invention pertains to a high Ti pitch for direct spinning into carbon fibers. An aromatic pitch with a very high liquid crystal fraction (80-100%) can be prepared by thermally reacting a deasphaltenated fraction of either a cat cracker bottom, steam cracker tar or a coal distillate, that are respectively rich in (4, 5 and 6); (2, 3, 4 and 5); and (3, 4, 5 and 6) aromatic rings. The various feedstocks are heat soaked in a temperature range from 420° C. to 450° C. at atmospheric pressure, and then vacuum stripped to remove at least a portion of the unreacted oils at a temperature in the approximate range of from 320° C. to 420° C. at 0.1 to 100 mmHg, and preferably at greater than 400° C. at 5.0 mmHg of pressure.

More specifically, in the case of cat cracker bottoms the fraction is heat soaked at approximately 440° C. for 2-4 hours at atmospheric pressure. In the case of steam cracker tars, the fraction is heat soaked at 430° C. for approximately 4.0 hours; and in the case of coal distillate, the fraction is heat soaked at approximately 440° C. for ¼ to ½ hour. All the heat soaked materials are then vacuum stripped and spun directly into carbon fibers. The pitch of this invention is definable only in terms of deasphaltenated fractions of a feedstock.

For the purposes of definition the terms "deasphaltenated feedstock" and/or "deasphaltenated middle fraction of a feedstock" shall mean: a deasphaltenated material obtained from a middle cut of a feedstock, and/or one caused to be relatively free of asphaltenes by means of obtaining a distillate portion of said feedstock which when further treated will form a precursor which can be spun into a carbon fiber and which has the following general characteristics:

(1) a relatively low coking value;

(2) a relatively low content of ash and impurities; and (3) a relatively narrow average molecular weight range.

(4) Consisting of 3, 4, 5 and 6 polycondensed aromatics.

A typical weight percentage of asphaltenes in a substantially deasphaltenated coal distillate being in a range of approximately 5.0 to 10.0%.

A directly spinnable pitch of this invention has the proper rheological properties characterized as a glass transition temperature (Tg) in the approximate range of 180° C. to 250° C. at atmospheric pressure, and/or a viscosity of less than approximately 10,000 cps in a temperature range of approximately 360° C. at atmospheric pressure.

It is an object of this invention to provide an improved pitch which can be directly spun into carbon fibers.

It is another object of the invention to provide a pitch for manufacturing carbon fibers which is more uniform, and which is relatively free of ash and impurities.

It is a further object of this invention to provide a pitch having high toluene insolubles, and which does not require Ti solvent extraction prior to spinning into fibers.

These and other objects of this invention will be better understood and will become more apparent with reference to the following detailed description considered in conjunction with the accompanying drawings.

DETAILED DESCRIPTION OF THE INVENTION

Figure 1:
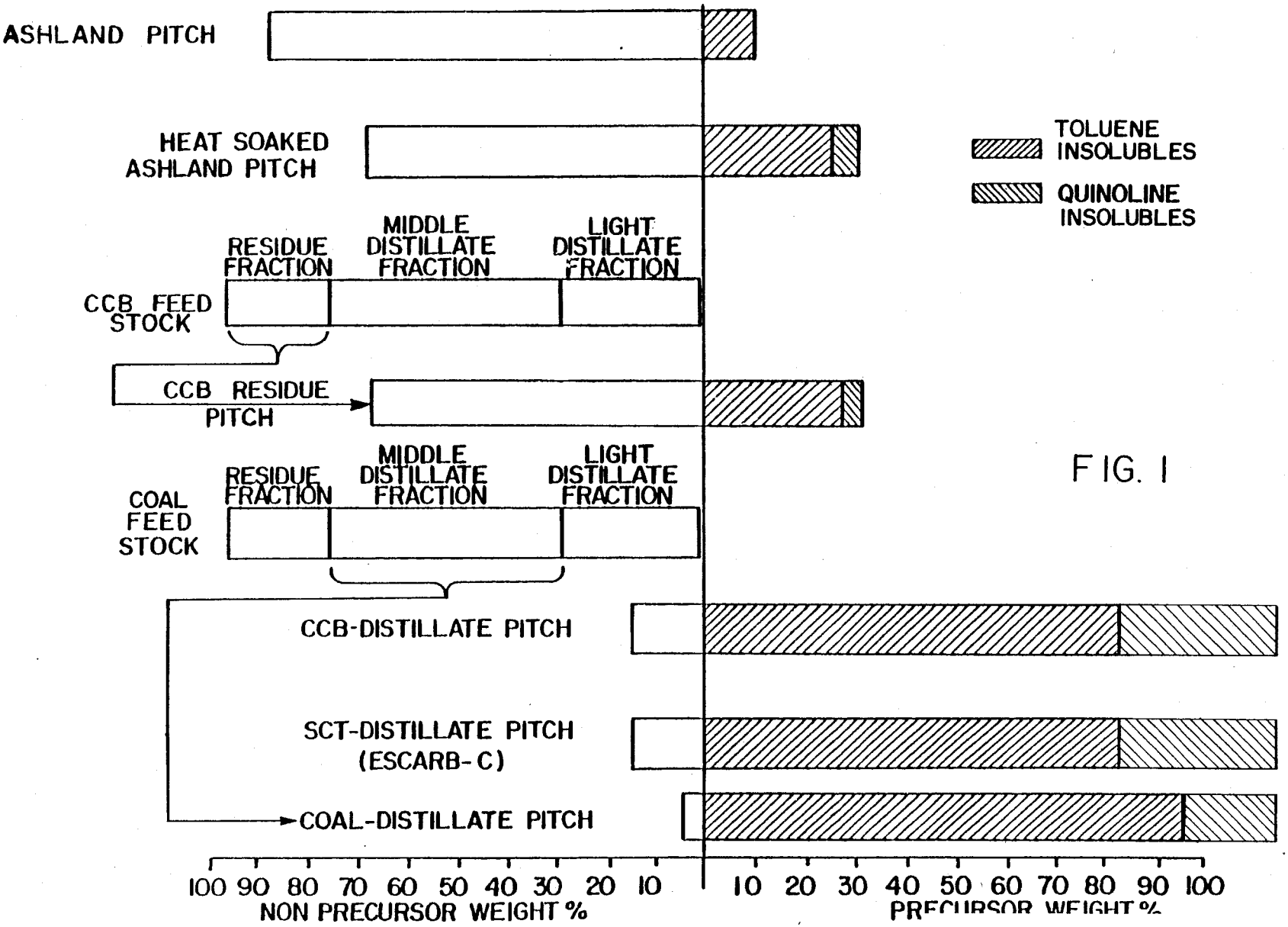
FIG. 1 is a graphical representation of deasphaltenated fractions of various feedstocks used to provide the inventive pitches for direct spinning into carbon fibers, including the deasphaltenated coal distillate of this invention.

Generally speaking, the pitch of this invention is one which has a high liquid crystal fraction as measured by the content of toluene insolubles, and which is further characterized as relatively free of impurities and ash as defined by a low quinoline insolubles content. The pitch of this invention is derived from a coal oil or coal tar fraction which is rich in 3, 4, 5 and 6 polycondensed aromatic rings.

Table 1, below, illustrates the characteristics of two coal distillates: (1) a coal oil obtained from coal gasification as an example of coal oils produced from a low temperature coal process; and (2) a coal tar distillate from the distillation of coal tar which is produced during coal coking operations, illustrating an example of a coal distillate from a high temperature process:

TABLE 1

Physical Characteristics of Coal Distillates from High and Low Temperature Coal Processing

| | Coal Oil from Coal Gasification Process | Coal Tar Distillate from Coal Coking Process |
|---|---|---|
| Specific Gravity @ 15° C. | 1.0071 | 1.0890 |
| Ash Content, wt % | <0.0001 | <0.0001 |
| Viscosity (cps) @ 210° F. | 2.92 | 4.10 |
| Flash Point (coc), °C. | 80 | 120 |
| n-Heptane Insolubles (asphaltene), wt % | 5.0 | 3.0 |
| Toluene Insolubles (0.35 + microns), wt % | 0.230 | 0.200 |
| Coking Value (2 hrs @ 550° C.) | 4.1 | 3.3 |
| Average Mol Wt | 201 | 192 |
| BMCI | 97 | 139 |

[BMCI = Bureau of Mines Correlation Index]

The aromaticity and the chemical structure of coal distillates vary from one type to another. The aromaticity of the coal oil is very much dependent on the coal processing temperature. Table 2, below, gives the aromaticity (aromatic carbon atoms as determined by $C_{13}$ NMR) and the chemical structure as defined by average proton distribution (by proton NMR) of the coal distillates respectively obtained by high and low temperature processing of coal:

TABLE 2

Aromaticity and Chemical Structure of Coal Distillates from High and Low Temperature Processing of Coal

| | Coal Oil from Coal Gasification Process | Coal Tar Distillate from Coal Coking Process |
|---|---|---|
| Aromaticity (%) (aromatic carbon atom) | 44–57 | 85–95 |
| Aromatic Protons (%) | 47 | 90 |
| Benzyllic Protons (%) | 36 | 34 |
| Paraffinic Protons (%) | 41 | 11 |
| Carbon Number in Side Chain | 3.2 | 1.3 |
| Naphthenic Carbon (%) of Total Paraffinic | 57 | 100 |

Coal contains carbon, hydrogen, oxygen, nitrogen and sulfur in comparison to petroleum-derived products, which contain hydrocarbon and sulfur. Coal distillates, contain carbon, hydrogen, nitrogen, sulfur and a relatively high content of oxygen. The elemental analysis of coal oil and coal tar distillates obtained from low and high temperature coal processes, are respectively given in Table 3, below:

TABLE 3

Elemental Analysis of Coal Distillates

| | Coal Oil from Coal Gasification Process | Coal Tar Distillate from Coal Coking Process |
|---|---|---|
| Carbon (wt %) | 82.92 | 91.72 |
| Hydrogen (wt %) | 9.18 | 6.05 |
| Nitrogen (wt %) | 1.04 | 0.83 |
| Oxygen (wt %) | 5.91 | 1.05 |
| Sulfur (wt %) | 0.84 | 0.50 |
| Sodium (ppm) | 3.3 | 10.0 |
| Potassium (ppm) | 1.8 | 1.0 |
| C/H Atomic Ratio | 0.75 | 1.26 |

Like other heavy aromatic residues from pyrolysis or cracking of a petroleum product, coal oils and coal tar distillates derived from low or high temperature coal processing contain a large quantity of polycondensed aromatics of a narrow aromatic ring distribution (mainly polycondensed aromatics with 3, 4, 5, and 6 rings. Table 4, below, gives the aromatic ring distribution and aromatic ring composition of coal oils and coal tar distillates.

TABLE 4

Aromatic Ring Distribution of Coal Distillates from Low and High Temperature Coal Processes

| Aromatic Ring Distribution | Coal Oil from Coal Gasification Process (Wt. %) | Coal Tar Distillate from Coal Coking Process (wt. %) |
|---|---|---|
| 1 | 26.0 | 13.0 |
| 2 | 45.7 | 36.8 |
| 3 | 14.6 | 22.6 |
| 4 | 10.3 | 21.8 |
| 5 | 2.3 | 4.5 |
| 6 | 0.7 | 1.0 |
| Hydrocarbon Aromatics | 77.9 | 74.0 |
| Oxygen Containing Aromatics | 13.8 | 16.6 |
| Sulfur Containing Aromatics | 8.2 | 9.3 |

Coal oils and coal tar distillates have a wide range of boiling point characteristics depending on the type of process and the corresponding process conditions. The boiling point characteristics of the coal distillate feed determine the part of the coal distillate which will remain during heat soaking in a reactor. This fraction will react to form pitch. The higher the boiling point of the oil or distillate, the higher will be the yield of the pitch. The distillation characteristics (ASTM D1160 method) of coal tar distillate from a coal coking process, and coal oil distillate from a coal gasification process, each rich in 3, 4, 5 and 6 polycondensed aromatic rings and which is useful in this invention, are given in Table 5, below:

TABLE 5

Distillation Characteristics of Coal Tar and Oil Distillates (ASTM D-1160)

| Volume % | Coal Oil from Coal Gasification Process (°C.) | Coal Tar Distillate from Coal Coking Process (°C.) |
|---|---|---|
| IBP | 71 | 213 |
| 1% | — | 235 |
| 5% | 137 | 253 |
| 10% | 160 | 276 |
| 20% | 188 | 303 |
| 30% | 218 | 316 |
| 40% | 243 | 328 |
| 50% | 271 | 335 |

TABLE 5-continued

| Distillation Characteristics of Coal Tar and Oil Distillates (ASTM D-1160) | | |
|---|---|---|
| Volume % | Coal Oil from Coal Gasification Process (°C.) | Coal Tar Distillate from Coal Coking Process (°C.) |
| 60% | 304 | 350 |
| 70% | 343 | 358 |
| 80% | 398 | 377 |
| 90% | 509 | 437 |

One can determine the molecular structure of coal distillates using advanced analytical methods such as a high resolution mass spectrometer (MS350) with computerized data acquistion and handling. Table 6, below, gives the compound type, and typical molecular structure of the oil from coal gasification, and distillate from a coal coking operation:

TABLE 6

| Molecular Structure of Coal Oil and Distillate | | | |
|---|---|---|---|
| Compound Type | Molecular Structure | Coal Oil from Coal Gasification Process (wt %) | Coal Tar Distillate from Coal Coking Process (wt %) |
| $C_nH_{2n-8}$ | Indanes | 6.0 | 1.7 |
| $C_nH_{2n-10}$ | Indenes | 9.5 | 2.0 |
| $C_nH_{2n-12}$ | Naphthalenes | 17.9 | 15.3 |
| $C_nH_{2n-14}$ | Naphthenonaphthalene | 7.5 | 6.2 |
| $C_nH_{2n-16}$ | Acenaphthalenes | 10.3 | 5.1 |
| $C_nH_{2n-18}$ | Phenanthrenes | 9.5 | 14.9 |
| $C_nH_{2n-20}$ | Naphthenophenanthrenes | 3.4 | 5.0 |
| $C_nH_{2n-22}$ | Pyrenes | 4.9 | 11.5 |
| $C_nH_{2n-24}$ | Chrysenes | 2.3 | 5.4 |
| $C_nH_{2n-26}$ | Cholanthrenes | 0.6 | 1.0 |
| $C_nH_{2n-10}S$ | Benzothiophenes | 2.3 | 1.4 |
| $C_nH_{2n-12}S$ | Naphthenobenzothiophenes | 1.3 | — |
| $C_nH_{2n-14}S$ | Indenothiophenes | 0.6 | 0.5 |
| $C_nH_{2n-16}S$ | Naphthothiophenes | 2.2 | 3.1 |
| $C_nH_{2n-18}S$ | Naphthenonaphthothiophenes | — | 1.0 |
| $C_nH_{2n-10}O$ | Benzofuraans | 2.7 | 0.9 |
| $C_nH_{2n-12}O$ | Naphthenobenzofurans | 0.8 | 1.0 |
| $C_nH_{2n-14}O$ | Indenobenzofurans | 0.6 | 0.3 |
| $C_nH_{2n-16}O$ | Naphthenofurans | 4.9 | 3.6 |
| $C_nH_{2n-18}O$ | Naphthenonaphthofurans | 0.8 | 0.6 |
| $C_nH_{2n-20}O$ | Acenaphthyenofurans | 0.5 | 0.5 |
| $C_nH_{2n-22}O$ | Phenauthrenofurans | 1.6 | 1.9 |

To produce a pitch in accordance with the present invention, a coal oil or coal tar distillate feedstock rich in 3, 4, 5 and 6 polycondensed aromatic rings as illustrated in Table 4, is heat soaked at temperatures in the range of about 430° C. to 440° C. at atmospheric pressure. In general, heat soaking is conducted for times ranging from ¼ to ½ hour. It is particularly preferred that heat soaking be done in an atmosphere of nitrogen, or alternatively in a hydrogen atmosphere.

When the heat soaking stage is completed, the reaction mixture is then subjected to a reduced pressure at a liquid temperature between 360°-430° C. (preferably at 400°-420° C.) to remove at least a portion of the unreacted oil. Preferably, all of the unreacted oils are removed to concentrate and increase the liquid fraction in the final pitch product. The use of a high liquid temperature; e.g., 400°-420° C., is very desirable. This helps to remove the distillable unreacted oils, which if left in the final pitch product, tend to reduce the liquid crystal content. Optionally, the pitch can be purged with nitrogen to accelerate the removal of oil from the pitch.

The resultant pitch product has a low melting point has a very high aromaticity (84% of aromatic carbon atoms by carbon NMR method) and contains a high liquid crystal fraction. The pitch composition is defined readily by using solvent analysis. The content of insolubles in toluene at room temperature, and the content of insolubles in quinoline at 75° C. defines the pitch. The toluene insoluble (Ti) fraction in the pitch can be used to give a measure of the liquid crystal content in the pitch. The objective of the invention is to obtain an aromatic pitch containing 80-100% (by weight) of toluene insolubles, and preferably 90-100% of toluene insolubles, as well as a high content of quinoline insolubles (at least 15%, between 15 and 50%) which can be spun directly into carbon fibers as shown in FIG. 1.

For a better understanding of the treatment particulars used to convert these distillates into pitch, please refer to U.S. application, Ser. No. 346,625 filed on Feb. 8, 1982, and which is meant to be incorporated herein by way of reference.

The present invention distinguishes over the invention of this referenced application most particularly in the heat soaking step of the process.

The pitches of all these inventions are definable only in terms of deasphaltenated fractions of a feedstock (FIG. 1).

Table 7 below, summarizes the heat soaking conditions for a variety of substantially deasphaltenated feedstocks, and the resultant characteristics of each pitch:

TABLE 7

| The Production of Directly Spinnable Pitch from Distillates of CCB, SCT and Coal | | | | | | | | | |
|---|---|---|---|---|---|---|---|---|---|
| | FEED | | | | | | | | |
| | | CCB-DISTILLATE | | | | SCT DISTILLATE | | COAL DISTILLATE | |
| Example | 1 | 2 | 3 | 4 | 5 | 6 | 7 | 8 | 9 |
| Heat-Soaking Process Conditions | | | | | | | | | |
| Temp (°C.) | 440 | 440 | 440 | 450 | 440 | 430 | 430 | 430 | 440 |
| Time (hrs) | 2 | 3 | 4 | 2 | 3½ | 4 | 4 | ½ | ¼ |
| Pressure: atmosphere | | | | | | | | | |
| Pitch Composition | | | | | | | | | |
| TiSep (%) | 84.5 | 86.8 | 91.7 | 89.9 | 94.4 | 86.0 | 89.1 | 97.0 | 97.5 |
| QiASTM (%) | 17.3 | 25.4 | 45.9 | 27.1 | 32.4 | 0.4 | 32.8 | 14.0 | 1.7 |
| RPI (%) | 39.1 | 50.0 | — | 49.9 | — | — | — | — | — |
| Glass Transition Temp (°C.) | | | | | | | | | |
| of total pitch | 194 | 213 | 228 | 214 | 220 | 193 | — | 183 | — |
| of TiSep | 235 | — | 248 | 239 | — | 245 | — | 210 | — |
| Elemental Analysis | | | | | | | | | |
| Carbon (%) | 93.99 | — | 93.48 | 92.89 | — | — | — | 89.88 | — |

TABLE 7-continued

The Production of Directly Spinnable Pitch from Distillates of CCB, SCT and Coal

| | FEED | | | | | | | | |
|---|---|---|---|---|---|---|---|---|---|
| | | CCB-DISTILLATE | | | | SCT DISTILLATE | | COAL DISTILLATE | |
| Example | 1 | 2 | 3 | 4 | 5 | 6 | 7 | 8 | 9 |
| Hydrogen (%) | 4.32 | — | 4.09 | 4.14 | — | — | — | 5.37 | — |
| Sulfur (%) | 1.5 | — | — | — | — | — | — | 0.41 | — |
| Oxygen (%) | — | — | — | — | — | — | — | 2.91 | — |
| Nitrogen (%) | — | — | — | — | — | — | — | 1.59 | — |
| Aromaticity | | | | | | | | | |
| Aromatic carbon atom (%) | 88 | — | — | — | — | — | — | — | — |
| C/H atomic ratio | 1.80 | — | 1.90 | 1.87 | — | — | — | 1.59 | — |
| Viscosity (cps) | | | | | | | | | |
| @ 310° C. | 1393 | — | — | — | — | — | — | — | — |
| @ 320° C. | 400 | — | — | — | — | — | — | — | — |
| @ 330° C. | 131 | — | — | 435 | — | — | — | — | — |
| @ 340° C. | — | — | 4352 | 218 | — | — | — | — | — |
| @ 350° C. | — | — | 1409 | — | — | — | — | — | — |

Figure 2:
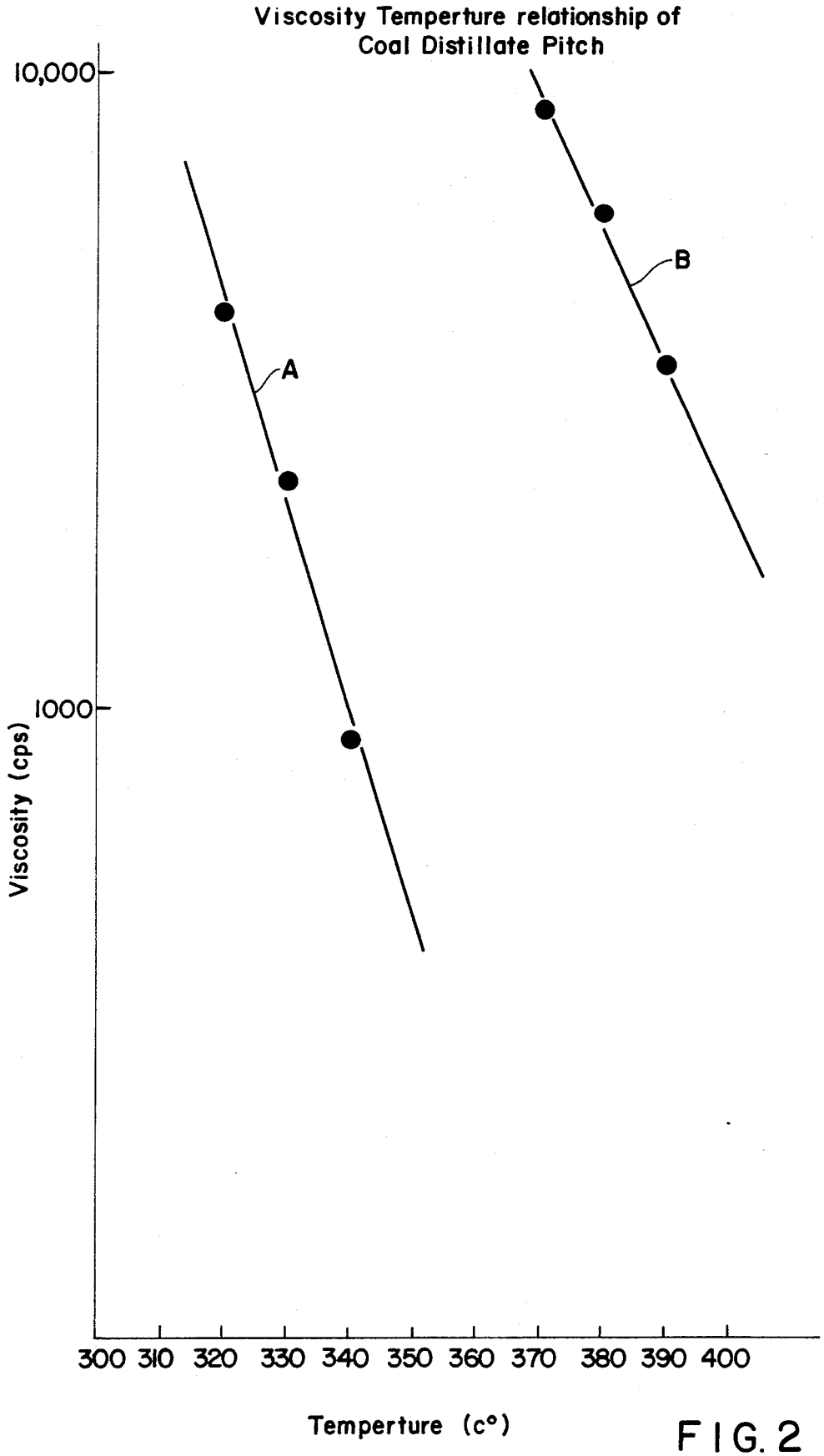
FIG. 2 shows a graph of viscosity vs. temperature for a number of pitches made from deasphaltenated coal distillates.

The rehology of pitches used for direct spinning is of great importance to obtain good spinnability. It is desired to have pitches with low viscosity at the spinning temperature which is preferrably below around 400° C., in order to avoid pitch cracking and volatilization which could lead to serious foaming of the fiber and substantial reduction in the fiber strength. The pitch for direct spinning is also desired to be less sensitive to heat, i.e. does not change its viscosity too much when changing temperature. The sensitivity of the pitch to temperature variation can be determined from viscosity-temperature curves. This relationship for several pitches designated A and B is shown in FIG. 2.

Differential Scanning Calorimetry (DSC) is used to obtain information on glass transition and softening characteristics of pitches. An OMINITHERM Corp. DCS Model (QC25) is used to obtain the glass transition (Tg) data. The method comprises heating a small sample of the pitch in the DSC pan, allowed to cool and the DSC trace was then obtained by heating at the rate of 10° C./min under nitrogen (30 cc/min). From the DSC trace three DSC data points are determined; the onset of Tg (Ti), the termination of Tg (Tf), and the Tg point which is at the midway between the Ti and Tf point. It has been reported that there is a relationship between the Tg of the pitch and its softening point as determined by the traditional method such as the ring and ball method. The softening point is higher by around 60° C. than the Tg.

Table 8 below, contains characteristics of four additional Examples A through D of coal distillate pitches which are directly spinnable into carbon fibers:

TABLE 8

PHYSICAL/CHEMICAL CHARACTERISTICS OF COAL DISTILLATE PITCHES

| EXAMPLE | A | B | C | D |
|---|---|---|---|---|
| Heat-Soaking Conditions | | | | |
| Temperature (°C.) | 430 | 430 | 430 | 430 |
| Time (min) | 15 | 30 | 40 | 55 |
| Vacuum-Stripping Conditions | | | | |
| Maximum Temperature (°C.) | 420 | 420 | 420 | 430 |
| Pressure (mmHg) | 1.0 | 1.0 | 0.5 | 1.5 |
| Pitch Composition | | | | |
| Toluene Insolubles (TiSep) (%) | 91.3 | 97.0 | 96.6 | 99.8 |
| Quinoline Insolubles (%) | 11.7 | 14.0 | 19.5 | 41.0 |
| Pyridine Insolubles (%) | 35.3 | 30.8 | 36.8 | 66.8 |
| Elemental Analysis | | | | |

TABLE 8-continued

PHYSICAL/CHEMICAL CHARACTERISTICS OF COAL DISTILLATE PITCHES

| EXAMPLE | A | B | C | D |
|---|---|---|---|---|
| Carbon (Wt. %) | 89.45 | 89.60 | 88.49 | — |
| Hydrogen (Wt. %) | 5.51 | 4.99 | 4.22 | — |
| Oxygen (Wt. %) | 1.40 | 1.76 | 2.10 | — |
| Nitrogen (Wt. %) | 1.70 | 1.61 | 1.62 | — |
| Sulfur (Wt. %) | 0.72 | 0.73 | 0.70 | — |
| Aromaticity | | | | |
| Aromatic Carbon Atom (%) | 88-87 | — | — | — |
| Carbon Hydrogen Atomic Ratio | 1.35 | 1.50 | 1.74 | — |
| Differential Scanning Calorimeter (DSC) | | | | |
| Initiation Temperature (Ti) (°C.) | 160 | 197 | 179 | — |
| Glass Transition Temperature (°C.) | 189 | 225 | 224 | — |
| Termination Temperature (Tf) (°C.) | 219 | 270 | 268 | — |

FIG. 2 is a graph of viscosity vs. temperature for Examples A and B depicted in Table 8 above. The viscosities of these pitches range from approximately 10,000 cps to 1,000 cps over a temperature range of 300° C. to 400° C., as shown.

Having thus described this invention, what is desired to be protected by Letters Patent is presented in the following appended claims.

What is claimed is:

1. A pitch suitable for carbon fiber manufacture which can be spun directly into pitch fibers, comprising approximately by weight content between 80 and 100 percent toluene insolubles and greater than 15 percent quinoline insolubles, said pitch having been derived, by heat soaking followed by vacuum stripping, from a substantially deasphaltenated fraction of a coal distillate rich in 3, 4, 5 and 6 polycondensed aromatic rings, and wherein said pitch is further characterized as being relatively free of impurities and ash.

2. A process for spinning a pitch, directly into pitch fibers, comprising the steps of:

(a) distilling a coal distillate feedstock to obtain a substantially deasphaltenated middle fraction rich in 3, 4, 5 and 6 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and greater than 15% quinoline insolubles; and (d) spinning said pitch directly into pitch fibers.

3. The process of claim 2, wherein said pitch comprises approximately 1 to 60 percent by weight pyridine insolubles.

4. The process of claim 2, wherein said pitch is further characterized as having a viscosity of less than approximately 10,000 cps at a temperature range of approximately 300° C., to 400° C., at atmospheric pressure.

5. The process of claim 2 wherein said pitch is also characterized by a glass transition temperature in the approximate range of 180° C. to 250° C., and a viscosity of less than approximately 10,000 cps in a temperature range of approximately 300° C., to 400° C., at atmospheric pressure.

* * * * *